United States Patent [19]

Wheten

[11] 4,317,426

[45] Mar. 2, 1982

[54] BLOW-OFF APPARATUS FOR ARTICLES WITHIN TUMBLING BARREL

[75] Inventor: Charles E. Wheten, Hilton, N.Y.

[73] Assignee: General Motors Corporation, Detroit, Mich.

[21] Appl. No.: 240,917

[22] Filed: Mar. 5, 1981

[51] Int. Cl.[3] ..... B05C 3/00

[52] U.S. Cl. ..... 118/418; 51/164.1; 134/102; 134/159; 134/183

[58] Field of Search ..... 118/418, 20, 18; 134/102, 159, 183; 51/164.1

[56] References Cited

U.S. PATENT DOCUMENTS 3,768,173 10/1973 Jessup ..... 34/131

*Primary Examiner*—Bernard D. Pianalto

*Attorney, Agent, or Firm*—Douglas D. Fekete

[57] ABSTRACT

An apparatus is disclosed for subjecting articles to a forceful air stream while confined within a tumbling barrel having a perforated peripheral wall. The apparatus comprises pivotally connected shroud members that are adapted to sealingly enclose the barrel, but to leave uncovered a bottom longitudinal portion of the perforated wall. Air is blown into the shroud members about the barrel and flows into the barrel through the perforated wall and thereafter out the barrel through the uncovered wall portion, thereby forcefully flowing over the confined articles to dislodge solution clinging thereto.

3 Claims, 5 Drawing Figures

BLOW-OFF APPARATUS FOR ARTICLES WITHIN TUMBLING BARREL

BACKGROUND OF THE INVENTION

This invention broadly relates to processing a plurality of small metal articles by immersion in surface treating baths while confined within a tumbling barrel. More particularly, this invention relates to an apparatus for blowing residual solution off confined articles after the barrel is raised from the bath.

Small metal articles, such as screws or washers, are processed in bulk through a series of cleaning, plating or other surface treating baths while within a tumbling barrel. The tumbling barrel comprises a perforated side wall for admitting solution when the barrel is submerged in a bath and for draining solution after the barrel is raised from the bath. After draining, solution clings to article surfaces or is trapped within the mass of articles. This residual solution, referred to as drag-out, wastefully removes chemical agents from the bath, which is particularly costly for expensive plating metals. In addition, drag-out contaminates the next bath, typically a rinse, which must be treated before being reused or discharged from the plant.

For large workpieces that are processed without a tumbling barrel, drag-out is substantially reduced by blowing solution back into the bath with a compressed airstream. However, this technique has not heretofore been satisfactory for tumbling barrels. When directed from outside the barrel, the airstream blows solution from the barrel wall onto the articles. Also, the perforated wall diffuses the airstream so that it is not sufficiently forceful to dislodge the solution. Introducing an air nozzle within the barrel interferes with processing operations and complicates article handling.

Therefore, it is an object of this invention to provide an apparatus for enveloping a perforated barrel in a manner such that residual treating solution may be blown off articles confined therein. The apparatus causes a forceful airstream to flow through the mass of articles and impinge upon their surfaces with sufficient force to dislodge solution therefrom. Thereafter, the airstream carries the solution out the barrel and back into the bath, thereby recovering it for future use and reducing contamination of subsequent baths.

It is a more particular object of this invention to provide a blow-off apparatus adapted to enshroud a tumbling barrel and to form therewith a plenum having a bottom air outlet such that compressed air blown into the plenum flows over confined articles to dislodge residual solution and to carry the solution out and into the bath, thereby reducing drag-out. The apparatus is adapted to accommodate an existing tumbling barrel. It does not require modification of the barrel, for example, to insert an air nozzle, and does not interfere significantly with processing operations.

SUMMARY OF THE INVENTION

In the preferred embodiment, these and other objects are accomplished by a blow-off apparatus that is adapted to close around a conventional tumbling barrel after the barrel is raised from a treating bath. The blow-off apparatus comprises two shroud members suspended above the bath. The shroud members are pivotable between a spread or open position for receiving and discharging the barrel and a closed position for enclosing the barrel. In the closed position, the shroud members sealingly encircle most of the circumference of the barrel to form a plenum therewith, but are shaped to leave only a longitudinal bottom strip of the barrel perforated wall uncovered.

During operation, air is blown into the plenum about the enshrouded barrel to build up pressure therein. This causes air to flow through the perforated wall into the barrel, then through a pile of articles in the barrel and then out the plenum through the uncovered portion of the perforated wall to the atmosphere. The force of the air flow dislodges solution out of the barrel and returns it to the bath, thereby reclaiming the solution for future use and reducing contamination of following baths. Thus, the blow-off apparatus of this invention is adapted for use with a tumbling barrel without modification of the barrel or significant interference with article treatment operations and substantially reduces wasteful and costly solution drag-out loss.

DESCRIPTION OF THE DRAWINGS

This invention will be better understood with reference to the following drawings wherein like elements are indicated by like numerals.

DETAILED DESCRIPTION OF THE INVENTION

Referring to the figures, a preferred blow-off apparatus 10 of this invention is carried on a horizontal structural beam 12. Beam 12 may, for example, be carried by a hoist assembly that is movable over a series of surface treating baths. In this case, the hoist might also carry the tumbling barrel from bath to bath with the blow-off apparatus. Alternately, blow-off apparatus 10 may be stationed above a particular bath to purge only barrels raised out of that bath. In either instance, the apparatus 10 is positioned above a bath so as to engage a tumbling barrel emerging from the bath.

Figure 1:
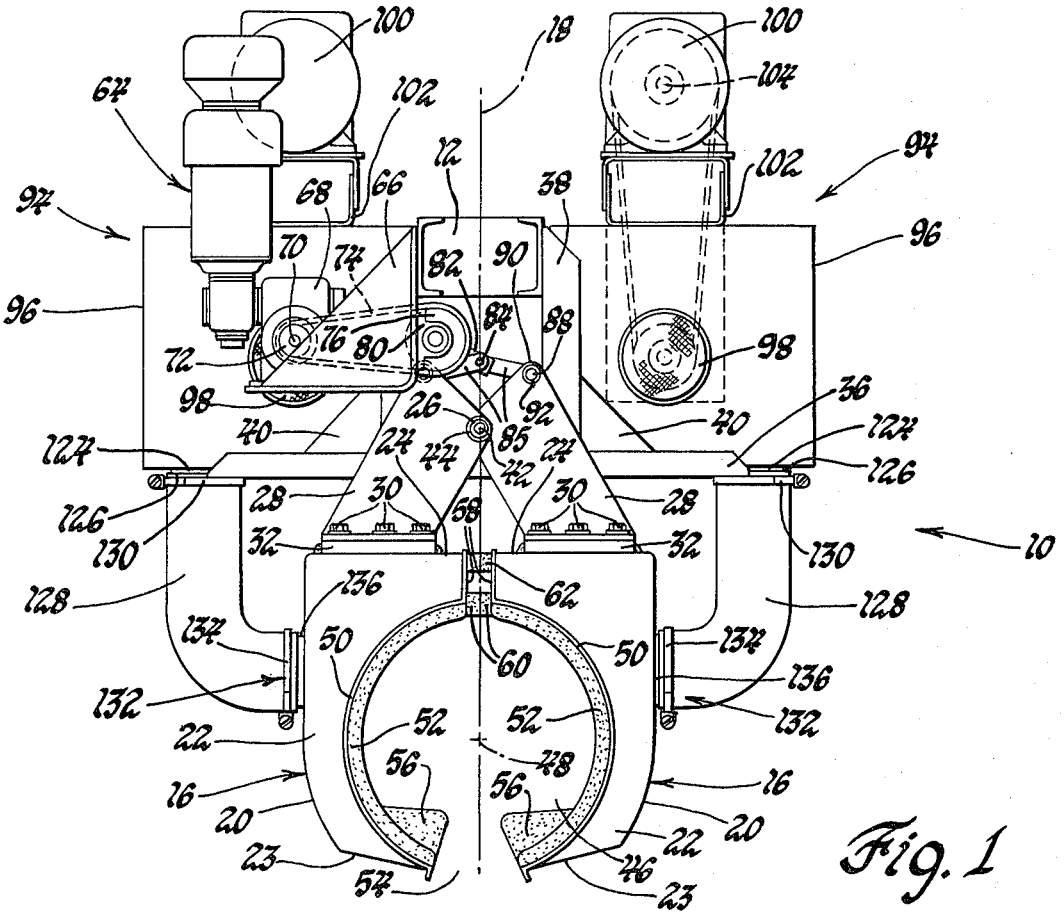
FIG. 1 is an end view of the apparatus of this invention.
Figure 2:
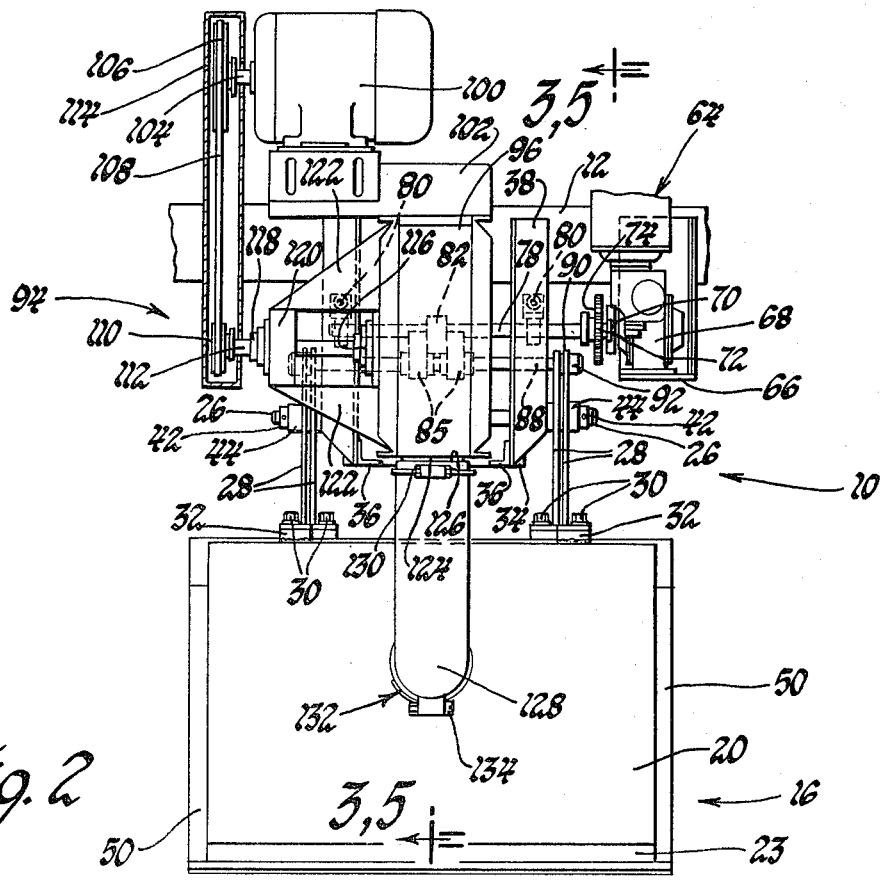
FIG. 2 is a side plan view of the apparatus in FIG. 1.

Blow-off apparatus 10 comprises a pair of substantially identical shroud members 16 arranged in substantial mirror image about vertical plane 18. Each shroud member 16 comprises sidewall 20, end wall 22, bottom wall 23 and top wall 24. Each shroud 16 is independently suspended from a horizontal pivot pin 26 by a pair of connecting plates 28 attached by fasteners 30 to pads 32 welded to top walls 24. Pin 26 lies in vertical plane 18 and is loosely held by mounts 34 affixed to horizontal angle iron beams 36, which are suspended from crossbeam 12 by vertical angle iron beams 38 and gussets 40. End collars 42 hold pin 26 in place. Bearings 44 affixed to plates 28 about pin 26 permit shrouds 16 to pivot between a closed position shown in FIGS. 1 and 5, and an open position shown in FIG. 3.

In the closed position, shroud end walls 22 define generally circular openings 46 centered about horizontal axis 48 in plane 18. As will be seen, openings 46 are adapted to be closed by a coaxially aligned tumbling barrel. Flanges 50 protrude outwardly from end walls 22 about openings 46 and carry radially inwardly resilient members 52 adapted for sealing against an enclosed barrel sidewall. Shroud walls 23 are spaced apart in the closed position to define an axial opening 54. Resilient members 56 protrude inwardly from walls 23 along opening 54 and are adapted to seal against an enclosed barrel. Each shroud 16 also has a wall 58 perpendicularly depending from top wall 24. Walls 58 are spaced parallel in the shroud closed portion and carry two facing resilient members 60 and 62 that sealingly meet and define an axial passage adapted to receive a barrel drive shaft, for example, 230 in FIG. 4. Upper sealing members 62 are redundant for sealing closed shrouds 16.

Figure 5:
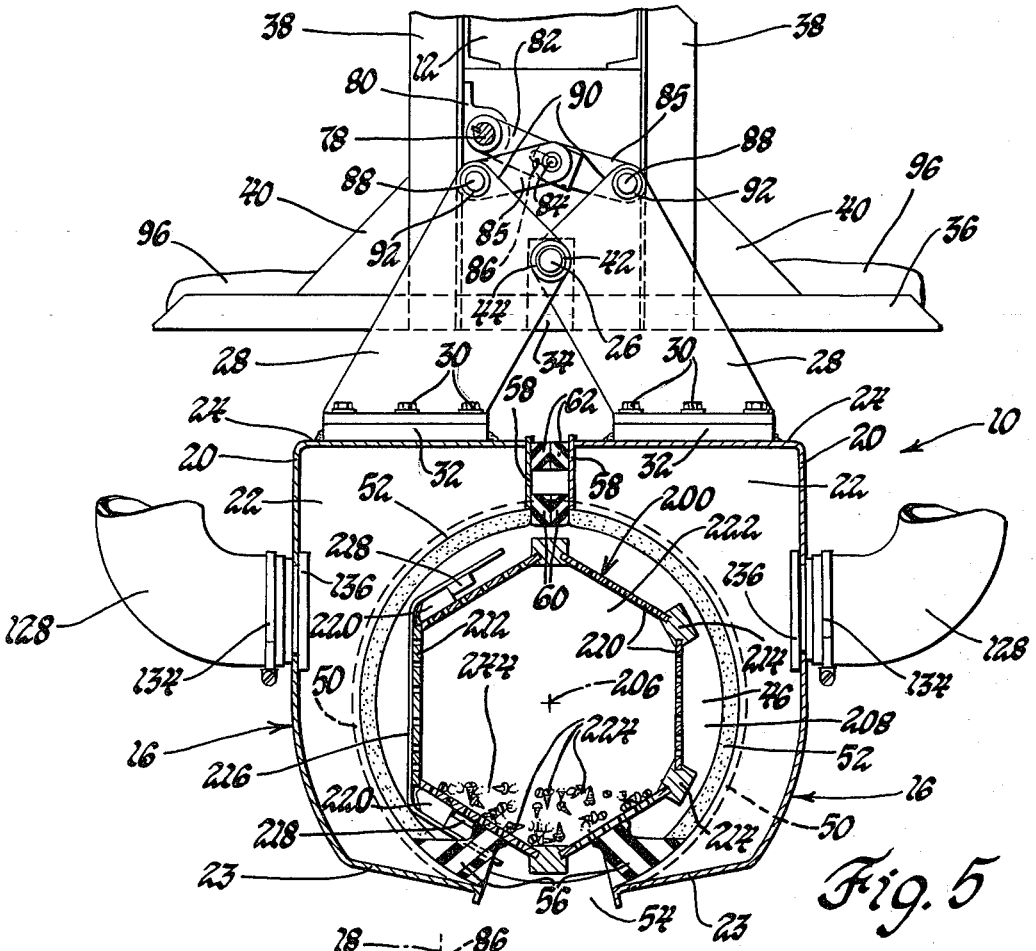
FIG. 5 is a cross-sectional view of the apparatus in FIG. 2 taken along line 5—5, but showing the shroud members in the closed position and engaging the tumbling barrel of FIG. 4.

Shrouds 16 are pivoted between open and closed positions by motor 64. Motor 64 is mounted upon a ledge 66 that is fixed to crossbeam 12 apart from beams 36 and 38. Motor 64 is operatively connected to a reducer 68 and thereby to drive shaft 70 and an affixed sprocket 72. Sprocket 72 drives chain 74 that in turn rotates a larger sprocket 76 fixed to a toggle drive shaft 78. Shaft 78 is rotatably mounted in pillow block bearing mounts 80 fixed to beams 38. As seen better in FIGS. 3 and 5, a toggle member 82 is secured to drive shaft 78 and supports a shaft 84 generally above and parallel to axis 48. Depending from shaft 84 is a pair of linking members 85. As seen in FIG. 5, shaft 84 rests loosely in oval holes 86 in links 82.

Each member 85 connects to a shaft 88 that is pivotably mounted in an upper corner 90 in connector plate 28 and held by end collars 92. Each corner 90 lies on the same side of plane 18 as the corresponding shroud 16 and is positioned above pin 26.

Figure 3:
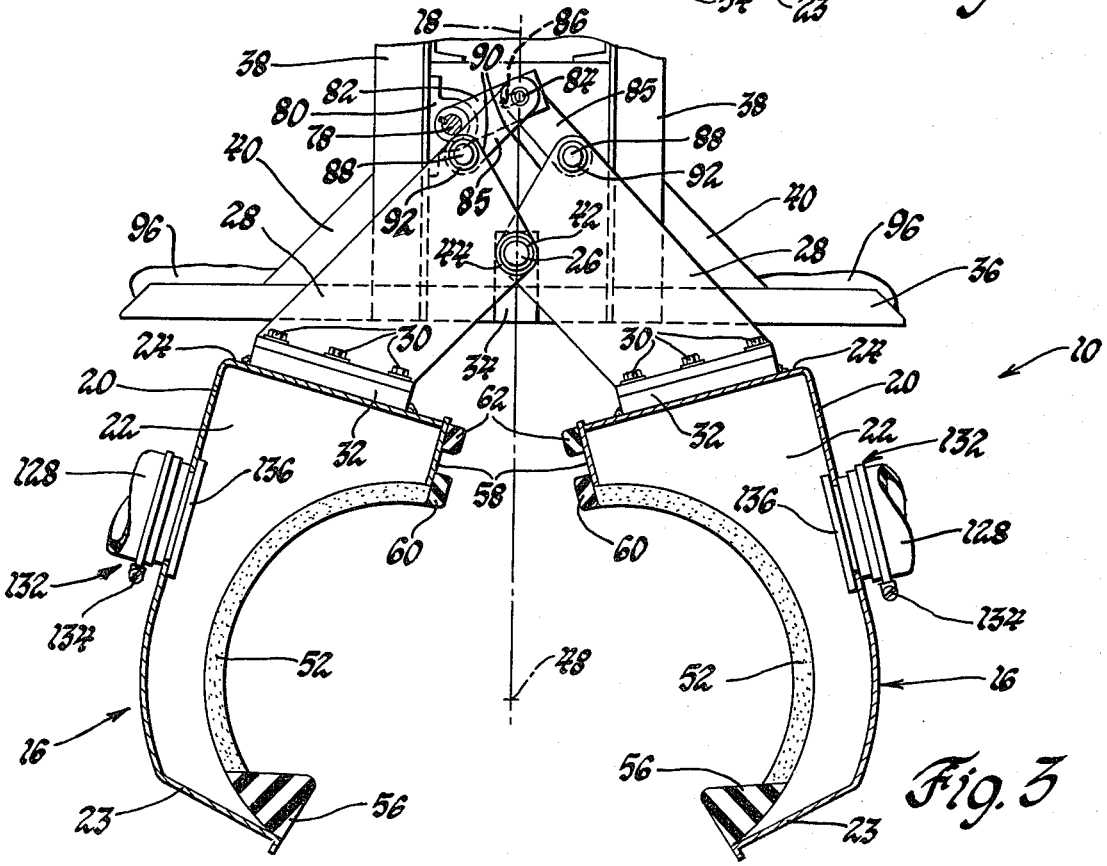
FIG. 3 is a cross-sectional view of a portion of the apparatus depicted in FIG. 2 taken along line 3—3, but illustrating the shroud members in open position.

Toggle member 82 is pivotable by drive shaft 78 between a downwardly inclined position in FIG. 5 and an upwardly inclined position in FIG. 3. In the downward position, shrouds 16 hang principally from pin 26 and rest in the closed position by contact between sealing members 60 and 62. When motor 64 is actuated by an operator to rotate shaft 78 to pivot toggle member 82 upward, shaft 84 and links 85 are raised, thereby pinching corners 90 inward towards plane 18 and rotating shrouds 16 about pin 26 to spread the shrouds into the open position. The play provided by holes 86 permit shaft 84 to be raised and lowered in plane 18. Alternately, motor 64 may be reversed to rotate shaft 78 to pivot toggle member 84 downward and thereby return shrouds 16 to the closed position.

Blow-off apparatus 10 further comprises two blowers 94 for introducing air between shrouds 16, one for each shroud. Each blower 94 comprises a conventional centrifugal blower fan (not shown) enclosed in a housing 96 having a screened air inlet 98. Each blower 94 is operated by an electric motor 100 mounted on a plate 102 atop of housing 96. Motor 100 features an output shaft 104 that turns a larger-diameter sheave 106, that drives a belt 108 and thereby turns sheave 110 mounted to a drive shaft 112 for the centrifugal blower fan ( not shown). Sheaves 106 and 110 and belt 108 are safely enclosed within a housing 114. Blower drive shaft 112 is rotatably held by a first bearing 116 mounted in housing 96 and a second bearing 118 mounted in a plate 120 held by flanges 122. Housing 96 features an air outlet 124 surrounded by a collar 126 and leading to a flexible tubing 128, secured by a screw clamp 130. Tube 128 extends to an air inlet 132 in side wall 20 of shroud 16 and is clamped by screw clamp 134 to a collar 136 surrounding the inlet.

Figure 4:
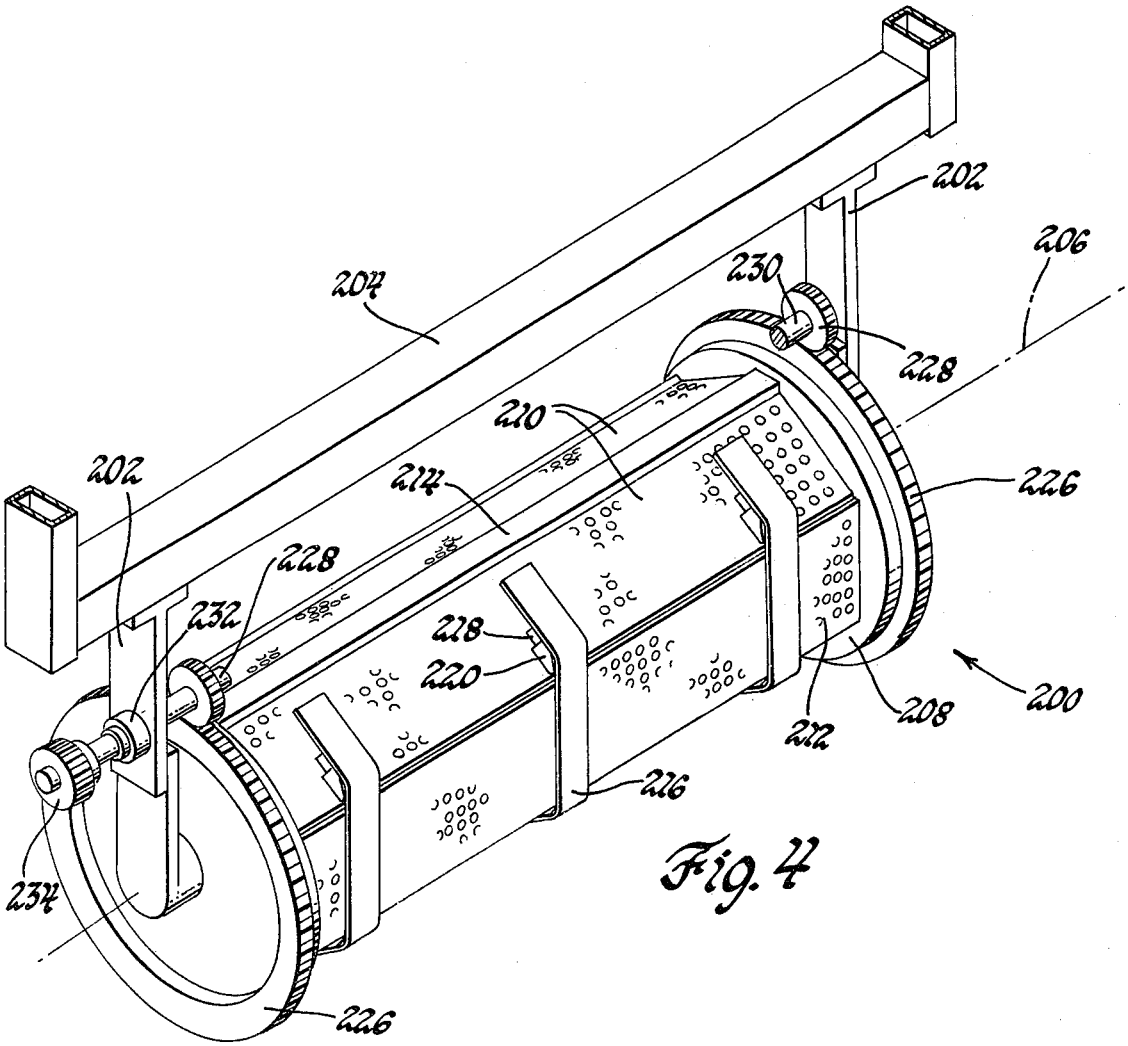
FIG. 4 is a perspective view of a tumbling barrel suitable for use with the blow-off apparatus in FIG. 1 in accordance with this invention.

Apparatus 10 is particularly adapted for use with a preferred tumbling barrel 200, seen in FIG. 4. Barrel 200 is supported by arms 202 suspended from yoke 204 that is adapted to be carried by a suitable hoist assembly and to be raised and lowered for immersing barrel 200 in processing baths. Barrel 200 is rotatably connected to arms 202 so as to be rotated about axis 206 for tumbling articles during processing.

Tumbling barrel 200 comprises solid circular end walls 208 and six perforated flat side wall panels 210, one of which is a door 212. Panels 210 are arranged in hexagonal cross section and rigidly held, except for door 212, by axial ribs 214. Door 212 is removably mounted for loading and unloading articles by spring retainer 216 having end locks 218 adapted to snap over blocks 220 affixed to wall panels adjacent door 212 to securely hold the door in the desired hexagonal arrangement. Thus, perforated panels 210 and end walls 208 define a hexagonal chamber 222 for containing articles 224 for surface treatment, as seen in FIG. 5.

Barrel 200 is rotated by annular spur gears 226 outwardly and concentrically affixed to end walls 208 and having a diameter larger than the adjacent wall. Gear 226 meshes with smaller spur gears 228 on a drive shaft 230 rotatably held by bearings 232 mounted through arms 202. Spur gears 234 at the ends of shaft 230 are adapted to mesh with motor-driven gears (not shown) when barrel 200 is immersed for rotating the barrel to tumble the confined articles.

During processing, barrel 200 is immersed in a bath to fill chamber 222 with treating solution. After treatment, tumbling is discontinued, whereupon articles 224 settle into a pile 244 in the bottom of chamber 222, in FIG. 5. The hoist is positioned above a tumbling barrel 200 in the bath so that the axis 206 lies in plane 18 parallel to axis 48. Toggle drive shaft 78 is rotated so that the toggle member 82 is upwardly inclined, thereby placing shrouds 16 in the open position, seen in FIG. 3. Barrel 200 is raised above the bath by the hoist arms (not shown) until axis 206 coincides with the axis 48. Most of the solution in chamber 222 drains through perforated walls 210. However, residual solution clings to articles 224 or is trapped in pile 244.

After the barrel is lifted into position, motor 64 is actuated to partially rotate drive shaft 78 to pivot toggle member 82 downwardly, thereby lowering shaft 84, spreading apart upper plate corners 90, and pivoting shroud members 16 into the closed position about the barrel, as seen in FIG. 5. Seals 52 engage barrel end walls 208 and seals 56 engage panels 210 so that the barrel is sealed within the shroud except for longitudinal opening 54. As seen in FIG. 5, resilient seals 56 suitably deform to seal about barrel door retainer 116. During closing, barrel drive shaft 230 is received between sealing members 60 and 62 and between walls 58. Yoke 204 rests about sealing members 62 and between plates 28 so as not to interfere with closing.

After barrel 200 is enshrouded within members 16, blower motor 100 is actuated to force air through flexible tube 126 into closed shrouds 16 and thereafter through perforation barrel walls 212 into chamber 222. Air pressure builds up in chamber 222 and creates a pressure drop across opening 54. Air flowing in response to the pressure drop forcefully passes through pile 244, dislodging solution trapped therein and solution clinging to articles 224. The air flow carries the dislodged solution downwardly out opening 54 and back into the bath. Thereafter, blower motors 100 are halted and motor 64 is actuated to rotate shaft 78 in the reverse direction to pivot toggle member 82 upward to open shrouds 16. Hoist 14 carries barrel 200 to a next treating bath or work station.

While this invention has been described in terms of one embodiment thereof, it is not intended to be limited to the above description, but rather only to the extent set forth in the claims that follow.

The embodiments of the invention in which an exclusive property or privilege is claimed are defined as follows:

1. An apparatus for directing a forceful gas stream through a plurality of articles contained within a barrel having a perforated peripheral wall when said barrel is oriented such that said articles are collected in a pile overlying a portion of said wall, said apparatus comprising gas-impervious barrel enclosure means sized and shaped to be positioned about the barrel to cover the portion of the peripheral wall that does not lie adjacent the articles such that gas leaving the barrel must flow through the pile to reach the ambient atmosphere, and means for admitting gas into the enclosure means when in position about the barrel to force gas into the barrel through the covered portion of the peripheral wall and out the uncovered portion.

2. An apparatus for subjecting articles to a forceful air stream while confined within a barrel having a perforated peripheral wall and oriented such that said articles collect in a pile adjacent a portion of said walls, said apparatus comprising shroud members movable between an open position for admitting the barrel and a closed position wherein said members sealingly enclose the barrel to form a plenum therewith, but leave uncovered a portion of the wall adjacent the articles, means for alternately opening said shroud members for receiving the barrel and closing said shroud members about the barrel, and means for blowing air into said shroud members in the closed position about the barrel such that air is forced into the barrel through the enclosed portion of the perforated wall and out of the barrel through the uncovered portion of the perforated wall, whereby said air is forced to flow through the pile of articles to reach the uncovered portion.

3. An apparatus for subjecting articles to a forceful air stream while confined within a tumbling barrel of the type that is transiently submerged in a solution bath for treating the articles and thereafter raised above the bath, said barrel comprising fluid-permeable peripheral wall and fluid-impermeable end walls, and being oriented such that the articles collect in a pile overlying a bottom longitudinal portion of the peripheral wall, said apparatus being positioned to engage the barrel after it is raised and comprising two hingedly connected shroud members pivotable between a spread position and a closed position about an axis paralleling the longitudinal axis of the barrel when engaged, said shroud members being sized and shaped to close about the peripheral wall when the barrel is engaged to cover all but the bottom portion thereof and to define an opening adjacent the bottom wall portion, said members carrying peripheral resilient members located for sealing against the covered barrel about the end walls and along the peripheral wall about the opening so that air flow out from the covered barrel is through the uncovered bottom peripheral wall portion, means for pivoting the shroud members about the axis alternately to spread the shroud members for receiving the raised barrel and to close the shroud members about the barrel, and air blower means for forcefully blowing air into the shroud members sealed about the barrel to force air to flow into the barrel through the peripheral wall, through the pile of articles overlying the bottom wall portion and out the barrel.

* * * * *